US005790012A

United States Patent [19]

Nakatsu et al.

[11] Patent Number: 5,790,012

[45] Date of Patent: Aug. 4, 1998

[54] VARIABLE RESISTOR

[75] Inventors: Yoshiyuki Nakatsu, Mishima-gun; Hideaki Tsukada; Katsuhiro Onishi, both of Sabae; Miroyuki Kishishita; Yukinori Ueda, both of Fukui-ken, all of Japan

[73] Assignee: Murata Manufacturing Co., Ltd., Nagaokakyo, Japan

[21] Appl. No.: 654,148

[22] Filed: May 28, 1996

[30] Foreign Application Priority Data

May 29, 1995 [JP] Japan ..... 7-130509

[51] Int. Cl.[6] ..... H01C 10/26

[52] U.S. Cl. ..... 338/152; 338/150; 338/162; 338/163

[58] Field of Search ..... 338/162, 163, 338/166, 171, 170, 150–152, 159

[56] References Cited

U.S. PATENT DOCUMENTS

| | | | |
|---|---|---|---|
| Re. 25,510 | 1/1964 | Bourns | 338/150 |
| 3,576,510 | 4/1971 | Bruder . | |
| 3,657,688 | 4/1972 | Casey et al. | 338/150 |
| 3,686,608 | 8/1972 | Wahlberg | 338/162 |
| 3,729,817 | 5/1973 | De Rouen et al. . | |
| 3,760,322 | 9/1973 | Kogo et al. | 338/137 |
| 4,712,084 | 12/1987 | Okazaki et al. | 338/184 |
| 4,816,801 | 3/1989 | Spiller | 338/163 |
| 5,546,067 | 8/1996 | Schmidt et al. | 338/172 |
| 5,570,076 | 10/1996 | Erickson et al. | 338/163 |

FOREIGN PATENT DOCUMENTS

| | | | |
|---|---|---|---|
| 2708725 | 9/1977 | Germany | 338/162 |
| 4-32202 | 2/1992 | Japan | 338/166 |

*Primary Examiner*—Michael L. Gellner
*Assistant Examiner*—Karl Easthom
*Attorney, Agent, or Firm*—Burns, Doane, Swecker & Mathis, LLP

[57] ABSTRACT

There is provided a variable resistor having a small number of parts and having an excellent heat releasing property. A rotor is rotatably contained in a concave portion of a case. The rotor has a resistive element provided on the bottom thereof and electrodes connected to both ends of the resistive element. Arms of sliders are provided on the bottom of the concave portion of the case in a sliding relationship with the respective electrodes and resistive element. A metal cover is disposed on the upper surface of the case in contact with the rotor.

24 Claims, 6 Drawing Sheets

VARIABLE RESISTOR

BACKGROUND OF THE INVENTION

1. Field of the Invention

The present invention relates to variable resistors and, more particularly, to a semifixed type variable resistor.

2. Description of the Related Art

The conventional variable resistor shown in FIG. 12 is well known. As shown in FIG. 12, this variable resistor 50 is constituted by a substrate 51 having a resistor 52 and a collector electrode 53 on the surface thereof, a case 55 containing this substrate 51, a terminal 56 extending through the case 55 and connecting with the substrate 51, a rotor 61 contained in the case 55, a slider 62 disposed on the bottom of the rotor 61, a cover 65 for enclosing the rotor 61 in the case 55, and a sealing O-ring 68 disposed between the rotor 61 and the cover 65.

The conventional variable resistor 50 has various problems as listed below.

(1) It includes a number of parts, i.e., the substrate 51, case 55, terminal 56, rotor 61, slider 62, cover 65, and O-ring 68, which results in an increase in manufacturing cost.

(2) The terminal 56 must be connected to the substrate 51, which increases the number of manufacturing steps and reduces reliability of connection.

(3) The substrate 51 is clamped by a metal mold during insert molding of the substrate 51 in the case 55, which creates problems such as breakage of the substrate 51.

(4) It is difficult to release heat generated at the resistor 52 because of the structure wherein the resistor 52 is surrounded by the case 55, slider 62, and rotor 61. Thus, this resistor is unusable in high power circuits.

It is therefore an object of the invention to provide a variable resistor which includes a small number of parts and has a structure that provides an excellent heat-releasing property.

SUMMARY OF THE INVENTION

In order to achieve the above-described object, according to the present invention, there is provided a variable resistor characterized in that it includes:

(a) a case having a concave portion;

(b) a plurality of terminals disposed on the case having a slider exposed on the bottom of the concave portion of the case;

(c) a rotor having a resistive element, an electrode, and a stopper on the surface thereof rotatably contained in the concave portion of the case; and (d) a metal cover disposed at the opening of the concave portion of the case having a stopper receiver for regulating the stopper of the rotor to regulate the rotational angle of the rotor, and in that:

(e) the slider is slidable on the resistive element and electrode.

The rotor having a resistive element on the surface thereof may be a ceramic rotor having a cermet resistor or carbon resistor on the surface thereof, a resin rotor having a carbon resistor thereon, or the like.

The present invention is further characterized in that the plurality of terminals have a gold plating film on one side thereof and in that the side having a gold plating film serves as a sliding surface of the slider and a soldering surface of the terminal.

It is another characteristic of the present invention that contact portions of the sliders of the plurality of terminals are aligned in the radial direction of the rotor and arms of the sliders are arranged diagonally to the radial direction of the rotor.

Further, the metal cover may have a mounting finger portion which is forced into a hole provided on the case to mount the metal cover to the case.

In the above-described configuration, there is no need for a substrate required in the prior art, and the terminals and sliders are integrated unlike the prior art wherein they are provided as separate parts. As a result, the number of parts is reduced. Heat generated at the resistive element is efficiently released to the atmosphere through the rotor or through the rotor and the metal cover in contact with the rotor.

Further, since gold plating films are provided on the sliding surfaces of the sliders and the soldering surfaces of the terminals, the sliders contact the resistive elements and electrodes with improved reliability and the terminals are favorably soldered to a circuit board or the like.

Furthermore, since the contact portions are aligned in the radial direction of the rotor and the arms of the sliders are arranged diagonally to the radial direction of the rotor, the length of the slider arms can be made large to improve the springing property of the sliders without increasing the size of the case.

In addition, since the metal cover is rigidly mounted to the case by forcing mounting finger portions of the metal cover into holes provided on the case, the vibration of the rotor is reduced. This suppresses the slippage of the contact position between the resistive element and the sliders, thereby allowing stable resistance setting.

DETAILED DESCRIPTION OF THE PREFERRED EMBODIMENT

An embodiment of a variable resistor according to the present invention will now be described with reference to the accompanying drawings.

Figure 1:
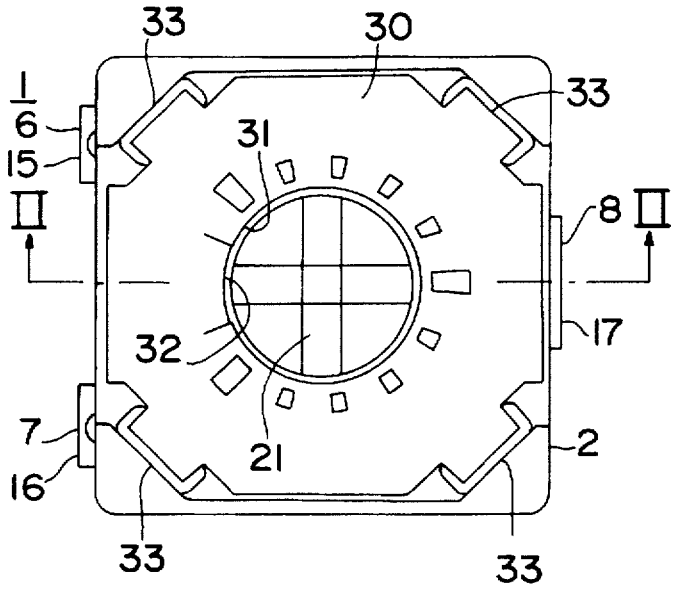
FIG. 1 is a plan view of an embodiment of a variable resistor according to the present invention.
Figure 2:
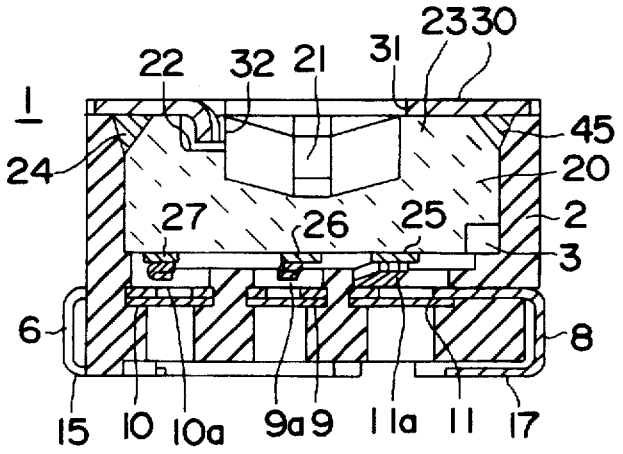
FIG. 2 is a sectional view of the variable resistor shown in FIG. 1 taken along the line II—II.
Figure 3:
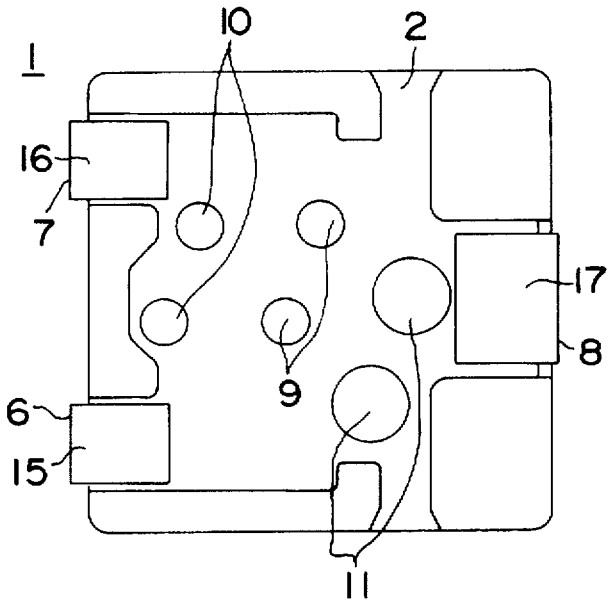
FIG. 3 is a bottom view of the variable resistor shown in FIG. 1.

As shown in FIGS. 1 through 3, a semifixed type variable resistor 1 is constituted by a case 2, terminals 6, 7 and 8, a rotor 20, a metal cover 30, and an O-ring 45.

Figure 4:
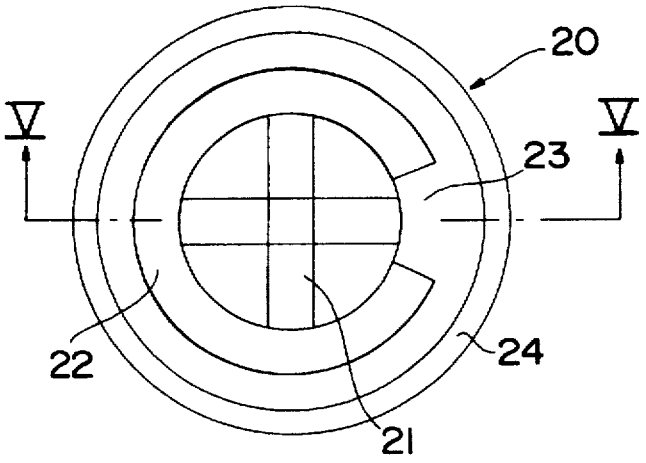
FIG. 4 is a plan view of the rotor used in the variable resistor shown in FIG. 1.
Figure 5:
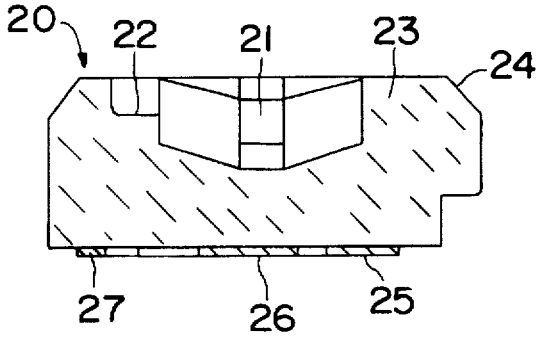
FIG. 5 is a sectional view of the rotor shown in FIG. 4 taken along the line V—V.
Figure 6:
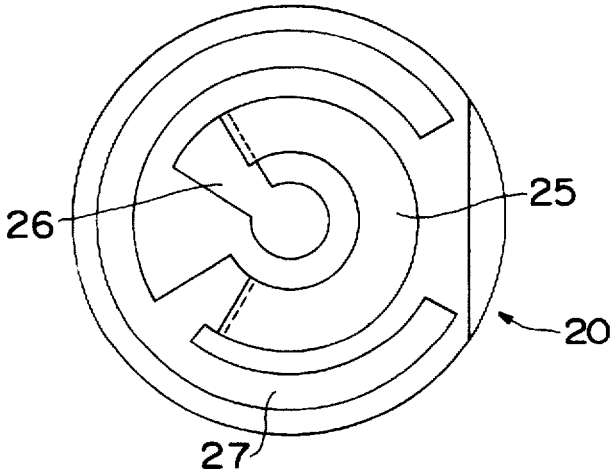
FIG. 6 is a bottom view of the rotor shown in FIG. 4.

As shown in FIGS. 4 through 6, the rotor 20 is cylindrical and has a cross groove 21 for a driver at the center of the upper surface thereof and a substantially arcuate escape groove 22 surrounding the same. Further, a stopper 23 is provided adjacent to this escape groove 22. The outer circumferential edge 24 of the upper surface of the rotor 20 is chamfered. A substantially arcuate resistive element 25 is provided on the lower surface of the rotor 20 by means of screen printing, transfer printing, or the like. Both ends of the resistive element 25 are electrically connected to an inner circumferential electrode 26 and an outer circumferential electrode 27. The inner circumferential electrode 26 has a circular portion located at the center of the rotor 20 while the outer circumferential electrode 27 has an arcuate portion located at the outer circumference of the rotor 20.

The rotor 20 is fabricated from a ceramic such as alumina or heat-resistant resin such as polyphenylene sulfide. The resistive element 25 is made up of a cermet resistor or carbon resistor. Especially, if polyphenylene sulfide and a carbon resistor, which are inexpensive, are used for the rotor 20 and the resistive element 25, respectively, the manufacturing cost of the variable resistor 1 can be reduced.

Figure 7:
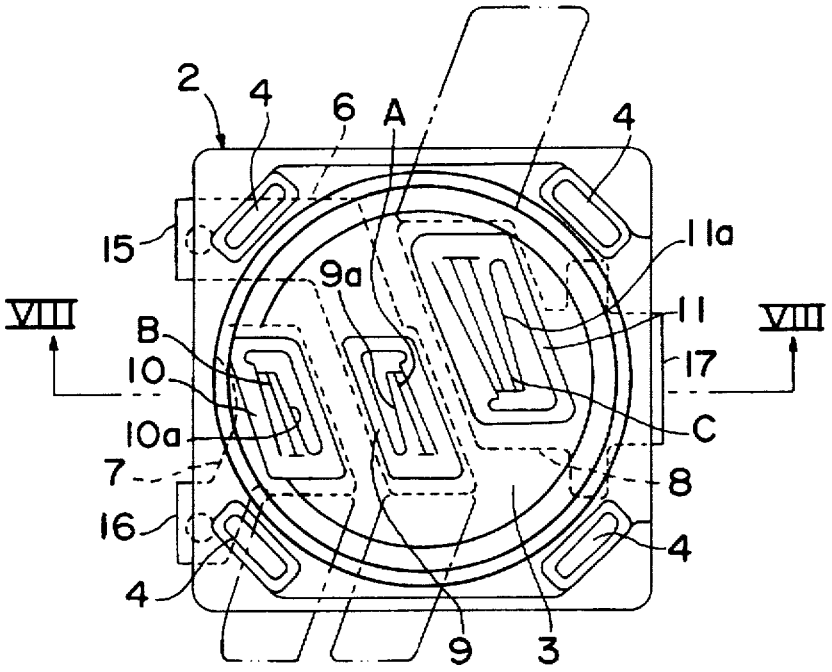
FIG. 7 is a plan view of the case used in the variable resistor shown in FIG. 1.
Figure 8:
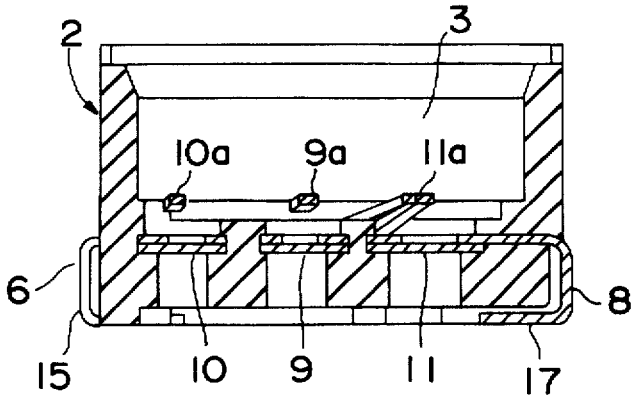
FIG. 8 is a sectional view of the case shown in FIG. 7 taken along line VIII—VIII.
Figure 9:
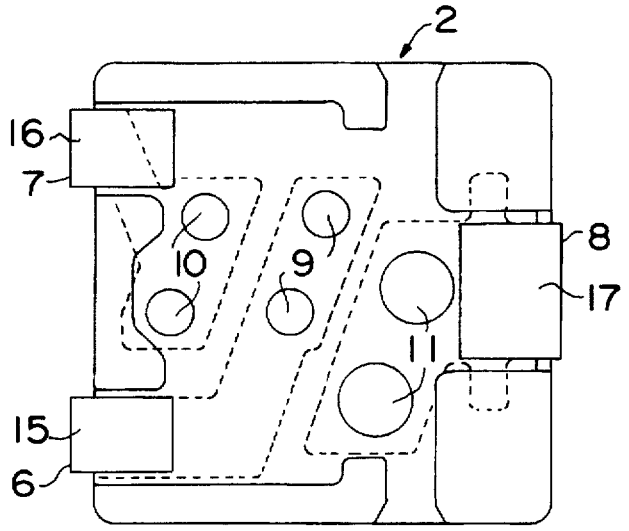
FIG. 9 is a bottom view of the case shown in FIG. 7.

As shown in FIGS. 7 though 9, the case 2 has a concave portion 3. The concave portion 3 has a circular transverse section in conformity to the shape of the rotor 20 and is designed to allow the rotor 20 contained in the concave portion 3 to rotate smoothly. Holes 4 are provided at four corners of the upper surface of the case 2. Terminals 6, 7 and 8 are insert-molded on the bottom of the case 2. Sliders 9, 10 and 11 provided at one end of, the terminals 6, 7 and 8, respectively, are exposed on the bottom surface of the concave portion 3. Lead portions 15, 16 and 17 provided on the other end are led out from the left and right sides of the case 2 and are bent along the sides of the case 2 to be surface-mounted.

The sliders 9, 10, and 11 have a structure wherein the portion indicated by two-dot chain line in FIG. 7 is bent and folded. This ensures the sealing of the case 2 and facilitates resin molding. Arms 9*a*, 10*a*, and 11*a* of the sliders 9, 10, and 11, respectively, project from the bottom of the concave portion 3 in the form of a comb. The peripheries of the sliders 9, 10, and 11 are embedded in the case 2 and the central portions thereof are partially cut out substantially in the form of "L" or "U". The cut-outs facilitate the molding of the arms 9*a*, 10*a*, and 11*a* in the form of a comb and prevent melted resin from sticking to the surface of the arms 9*a*, 10*a*, and 11*a* during the molding of the case 2 from resin.

A, B and C respectively represent contact portions where the arms 9*a*, 10*a*, and 11*a* contact the electrodes 26 and 27 and the resistive element 25 of the rotor 20, respectively. The contact portions A, B and C are aligned in the radial direction of the rotor 20, and the arms 9a, 10*a*, and 11*a* of the sliders 9, 10 and 11, respectively, are diagonal to the radial direction of the rotor 20. Therefore, the arms 9*a*, 10*a* and 11*a* of the sliders 9, 10 and 11 can be made longer than in the case wherein they are disposed orthogonally to the radial direction of the rotor 20. This provides a favorable springing property.

The terminals 6, 7 and 8 have a gold plating film formed on only one side thereof, and these sides having a gold plating film serve as sliding surfaces of the sliders 9, 10 and 11 and also as soldering surfaces of the lead portions 15, 16 and 17 of the terminals 6, 7 and 8. This improves the reliability of contact between the sliders 9, 10 and 11 and the resistors 25 and the electrodes 26 and 27 formed on the rotor 20 and allows the lead portions 15, 16 and 17 of the terminals 6, 7 and 8 to be soldered to a circuit board or the like favorably. Since the formation of the gold plating films is required only on one side, the manufacturing cost can be reduced. Heat-resistant resin such as polyphenylene sulfide can be used as the material of the case 2, and nickel silver or the like having a springing property can be used as the material of the terminals 6, 7 and 8.

Figure 10:
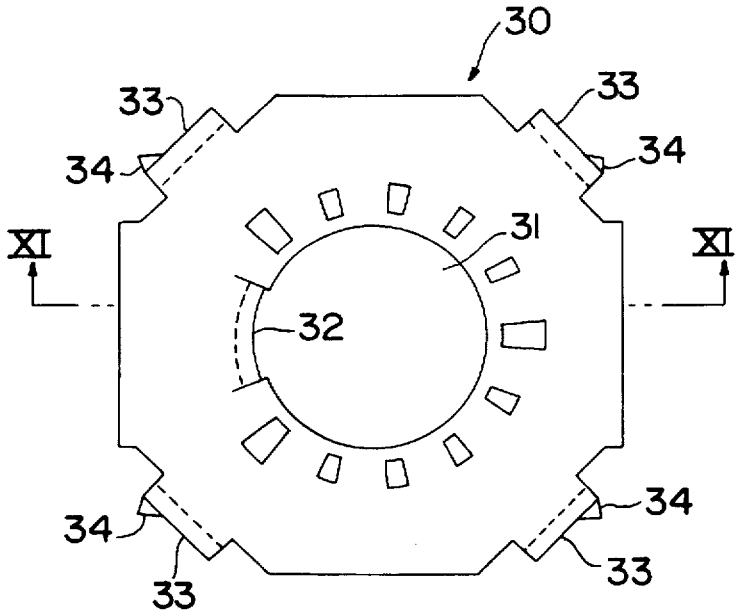
FIG. 10 is a plan view of the metal cover used in the variable resistor shown in FIG. 1.
Figure 11:
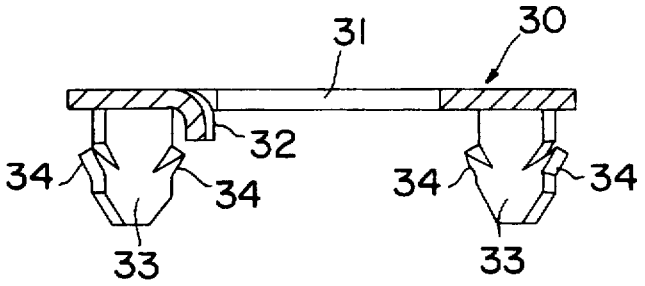
FIG. 11 is a sectional view of the metal cover shown in FIG. 10 taken along line X—X.
Figure 12:
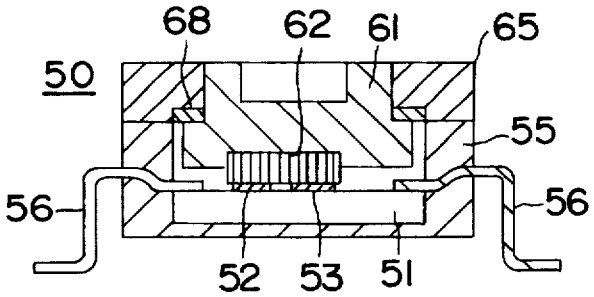
FIG. 12 PRIOR ART
FIG. 12 is a sectional view of a conventional variable resistor.

As shown in FIGS. 10 and 11, the metal cover 30 has a driver hole 31 at the center thereof, and a tongue-shaped stopper receiver 32 is provided adjacent to this hole 31. Mounting finger portions 33 are provided at four corners of the metal cover 20, and projections 34 are formed on the ends of the mounting finger portions 33 for preventing them from leaving the holes 4 once inserted therein. The metal cover 30 is made of a metal material such as stainless steel. The sealing O-ring 45 is made of silicon rubber or the like.

The above-described components are assembled according to the following procedure. The rotor 20 is placed in the concave portion 3 of the case 2 so that the resistive element 25 and the electrodes 26 and 27 thereof are in contact with the contact portions C, A and B, respectively. At this time, the upper surface of the rotor 20 is set slightly higher than the upper surface of the concave portion 3 of the case 2. This is to ensure the contact between the rotor 20 and the metal cover 30 to thereby reduce the vibration of the rotor 20. Next, the 0-ring 45 is inserted in the gap between the periphery 24 of the rotor 20 and the case 2. Thereafter, the metal cover 30 is placed over the case 2 so that it covers the case 2, and the mounting finger portions 33 are forced into the holes 4 of the case 2 to rigidly mount the metal cover 30 to the case 2 with the rotor 20 enclosed in the concave portion 3. This arrangement reduces the vibration of the rotor 20 and suppresses slippage of the positions where the resistive element 25 and the electrodes 26 and 27 contact the contact portions A, B and C, thereby allowing stable resistance setting.

In a variable resistor 1 assembled as described above, resistance between the terminals 6 and 8 or between the terminals 7 and 8 is varied by rotating the rotor 20 by fitting the tip of a screw driver into the cross groove 21 to cause the contact portions C, A and B to slide on the resistive element 25, the inner circumferential electrode 26, and the outer circumferential electrode 27, respectively. At this time, stopper receiver 32 provided on the metal cover 30 located in the escape groove 22 provided on the rotor 20, and this stopper receiver 32 regulates the stopper 23 provided on the rotor 20, thereby regulating the rotational angle of the rotor 20.

Further, the cross groove 21 for a driver provided on the top of the rotor 20 of the variable resistor 1 increases the surface area of the rotor 20, thereby allowing heat generated at the resistive element 25 to be released to the atmosphere efficiently. In addition, since the upper surface of the rotor 20 is in contact with the metal cover 30 having high thermal conductivity, the heat generated at the resistive element 25 is transferred to the metal cover 30 and is released to the atmosphere also from the metal cover 30.

A variable resistor according to the present invention is not limited to the above-described embodiment and may be modified in various ways without departing from the principles of the present invention. For instance, the projections formed on the ends of the mounting finger portions of the metal cover to prevent them from coming off may be in any form as long as the metal cover is rigidly fixed to the case.

As apparent from the above description, according to the present invention, there is no need for a substrate which has been required in the prior art and the terminals and sliders which have been separate parts are integrated. Therefore, the number of parts is reduced. The bonding of the terminals and the substrate which has been required in the prior art can now be omitted to reduce the number of manufacturing steps, which also improves reliability because there is no possibility of deterioration of the bonding.

Further, since heat generated at the resistive element is efficiently released to the atmosphere through the rotor or through the rotor and the metal cover in contact with the rotor, it is possible to provide a variable resistor which can withstand use at high power.

In addition, the gold plating films formed only on one side of the terminals keep the reliability of contact between the sliders and the resistive element and electrodes at the same level as that achievable when gold plating is performed on both sides of the terminals. Also, this allows the terminals to be soldered to a circuit board or the like favorably with a manufacturing cost lower than that required when the gold plating films are formed on the entire surface of the terminals.

The contact portions are aligned in the radial direction of the rotor, and the arms of the sliders are arranged diagonally to the radial direction of the rotor. This allows the length of the sliders to be set larger. As a result, sliders having a good springing property can be provided without increasing the size of the variable resistor.

Furthermore, the metal cover is rigidly mounted to the case by forcing the mounting finger portions of the metal cover into the holes provided in the case. This reduces the vibration of the rotor and suppresses the slippage of positions where the resistive element and electrodes contact the sliders, thereby allowing stable resistance setting.

While a particular embodiment of the present invention has been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A variable resistor comprising:

a case having a concave portion with a bottom portion herein;

a plurality of terminals disposed on said case, each terminal having a slider partialy embedded in said bottom portion, said slider having an arm portion projecting into said concave portion and a bent and folded portion folder under said arm portion and embedded in said bottom portion, the arm pottion being a cut out portion from a portion of said slider embedded in said case;

a rotor having a resistive element, an electrode, and a stopper on the surface thereof, said rotor being rotatably contained in the concave portion of the case; and a metal cover disposed at an opening of the concave portion of the case having a stopper receiver for receiving the stopper of the rotor to regulate the rotational angle of the rotor, wherein contact portions of the sliders are slidable on the resistive element and the electrode.

2. The variable resistor according to claim 1, wherein the rotor is made of ceramic and the resistive element comprises a cermet resistor or carbon resistor.

3. The variable resistor according to claim 1, wherein the rotor is made of resin and the resistive element comprises a carbon resistor.

4. The variable resistor according to claim 1, wherein each of the plurality of terminals have a gold plating film on one side thereof and wherein the side of each of the plurality of terminals having a gold plating film serve as a sliding surface of the slider and as a soldering surface of the terminal.

5. The variable resistor according to claim 2, wherein each of the plurality of terminals have a gold plating film on one side thereof and wherein the side of each of the plurality of terminals having a gold plating film serve as a sliding surface of the slider and as a soldering surface of the terminal.

6. The variable resistor according to claim 3, wherein each of the plurality of terminals have a gold plating film on one side thereof and wherein the side of each of the plurality of terminals having a gold plating film serve as a sliding surface of the slider and as a soldering surface of the terminal.

7. The variable resistor according to claim 1, wherein said contact portions of the sliders of the plurality of terminals are aligned in the radial direction of the rotor and said arms of the sliders are arranged diagonally to the radial direction of the rotor.

8. The variable resistor according to claim 2, wherein said contact portions of the sliders of the plurality of terminals are aligned in the radial direction of the rotor and said arms of the sliders are arranged diagonally to the radial direction of the rotor.

9. The variable resistor according to claim 3, wherein said contact portions of the sliders of the plurality of terminals are aligned in the radial direction of the rotor and said arms of the sliders are arranged diagonally to the radial direction of the rotor.

10. The variable resistor according to claim 4, wherein said contact portions of the sliders of the plurality of terminals are aligned in the radial direction of the rotor and said arms of the sliders are arranged diagonally to the radial direction of the rotor.

11. The variable resistor according to claim 5, wherein said contact portions of the sliders of the plurality of terminals are aligned in the radial direction of the rotor and a arms of the sliders are arranged diagonally to the radial direction of the rotor.

12. The variable resistor according to claim 6, wherein said contact portions of the sliders of the plurality of terminals are aligned in the radial direction of the rotor and arms of the sliders are arranged diagonally to the radial direction of the rotor.

13. The variable resistor according to claim 1, wherein the metal cover comprises a mounting finger portion which is located in a hole provided on the case to mount the metal cover to the case.

14. The variable resistor according to claim 2, wherein the metal cover comprises a mounting finger portion which is located in a hole provided on the case to mount the metal cover to the case.

15. The variable resistor according to claim 3, wherein the metal cover comprises a mounting finger portion which is located in a hole provided on the case to mount the metal cover to the case.

16. The variable resistor according to claim 4, wherein the metal cover comprises a mounting finger portion which is located in a hole provided on the case to mount the metal cover to the case.

17. The variable resistor according to claim 5, wherein the metal cover comprises a mounting finger portion which is located in a hole provided on the case to mount the metal cover to the case.

18. The variable resistor according to claim 6, wherein the metal cover comprises a mounting finger portion which is located in a hole provided on the case to mount the metal cover to the case.

19. The variable resistor according to claim 7, wherein the metal cover comprises a mounting finger portion which is located in a hole provided on the case to mount the metal cover to the case.

20. The variable resistor according to claim 8, wherein the metal cover comprises a mounting finger portion which is located in a hole provided on the case to mount the metal cover to the case.

21. The variable resistor according to claim 9, wherein the metal cover comprises a mounting finger portion which is located in a hole provided on the case to mount the metal cover to the case.

22. The variable resistor according to claim 10, wherein the metal cover comprises a mounting finger portion which is located in a hole provided on the case to mount the metal cover to the case.

23. The variable resistor according to claim 11, wherein the metal cover comprises a mounting finger portion which is located in a hole provided on the case to mount the metal cover to the case.

24. The variable resistor according to claim 12, wherein the metal cover comprises a mounting finger portion which is located in a hole provided on the case to mount the metal cover to the case.

* * * * *